US010208508B2

(12) United States Patent
Tien

(10) Patent No.: US 10,208,508 B2
(45) Date of Patent: Feb. 19, 2019

(54) MODULARIZED ELECTRIC DOOR LOCK

(71) Applicant: I-TEK METAL MFG. CO., LTD, Tainan (TW)

(72) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 174 days.

(21) Appl. No.: 15/401,277

(22) Filed: Jan. 9, 2017

(65) Prior Publication Data

US 2018/0171666 A1 Jun. 21, 2018

(30) Foreign Application Priority Data

Dec. 19, 2016 (TW) ..... 105219263 U

(51) Int. Cl.

| | |
|---|---|
| ***E05B 55/00*** | (2006.01) |
| ***E05B 9/08*** | (2006.01) |
| ***E05B 47/06*** | (2006.01) |
| ***E05B 63/00*** | (2006.01) |
| ***G07C 9/00*** | (2006.01) |
| *E05B 47/00* | (2006.01) |
| *E05B 35/00* | (2006.01) |

(52) U.S. Cl.

CPC ..... *E05B 55/005* (2013.01); *E05B 47/0661* (2013.01); *E05B 63/0056* (2013.01); *G07C 9/00563* (2013.01); *E05B 9/08* (2013.01); *E05B 47/0012* (2013.01); *E05B 2035/009* (2013.01); *E05B 2047/0023* (2013.01); *E05B 2047/0058* (2013.01); *E05B 2047/0094* (2013.01)

(58) Field of Classification Search

CPC ..... E05B 55/005; E05B 63/0056; E05B 47/0661; E05B 2047/0094; E05B 2047/0023; E05B 2035/009; E05B 47/0012; E05B 9/08; E05B 2047/0058; G07C 9/00563

USPC .. 70/277, 278.1, 278.2, 278.3, 278.7, 279.1, 70/280–283, 283.1; 292/144

See application file for complete search history.

(56) References Cited

U.S. PATENT DOCUMENTS

| | | | | |
|---|---|---|---|---|
| 5,421,178 | A * | 6/1995 | Hamel | E05B 47/0661 292/144 |
| 6,038,896 | A * | 3/2000 | Chamberlain | E05B 47/0012 70/277 |
| 8,349,480 | B1 * | 1/2013 | Chiang | G06F 1/1635 320/112 |
| 9,435,143 | B2 | 9/2016 | Shen | E05B 55/005 |
| 9,562,370 | B2 * | 2/2017 | Ohl | E05B 47/068 |
| 2012/0006082 | A1 * | 1/2012 | Peng | E05B 47/068 70/277 |

(Continued)

*Primary Examiner* — Lloyd A Gall
(74) *Attorney, Agent, or Firm* — Alan D. Kamrath; Kamrath IP Lawfirm, P.A.

(57) ABSTRACT

A modularized electric door lock includes an operating device mounted to a door, an outer electric device mounted to an outer side of the door for receiving an unlocking signal, and an inner electric device mounted to an inner side of the door and controlling the outer electric device. The inner electric device includes an electric driving device mounted in the operating device for setting the operating device to a locked state or an unlocked state. The outer electric device and the corresponding inner electric device can be selected among various types, such that the door lock of a desired type can be rapidly assembled.

18 Claims, 14 Drawing Sheets

(56) References Cited

U.S. PATENT DOCUMENTS

2012/0055213 A1* 3/2012 Sorensen ..... E05B 47/068
70/279.1
2014/0260451 A1* 9/2014 Quach ..... E05B 47/0012
70/278.1
2015/0240530 A1* 8/2015 Mani ..... E05B 63/04
292/336.3
2015/0315816 A1* 11/2015 Gopalakrishnan .....
E05B 27/0003
70/344

* cited by examiner

MODULARIZED ELECTRIC DOOR LOCK

BACKGROUND OF THE INVENTION

The present invention relates to a modularized electric door lock and, more particularly, to a modularized electric door lock whose type can be optionally changed by selecting one of a plurality of outer electric devices (such as a wireless transmitter, a keypad type input device, a touch screen, a biological feature pickup device, etc.) and by coupling a mechanical structure and an inner electric device for controlling the outer electric device.

There are various types of electric door locks, and some of them utilize radio frequency technology to produce door access cards and a radio frequency transmitter/receiver to communicate with the door access cards for controlling unlocking of the electric door lock. Another type of door lock utilizes a keypad for inputting a pin number for unlocking purposes. A further type of door lock includes a biological feature (such as fingerprints, veins of fingers, iris, etc.) pickup device mounted on an outer side of the door lock for picking up the biological feature to thereby control unlocking of the door lock.

Manufacturers providing various types of electric door locks having different designs must prepare more parts for inventory, leading to an increase in the costs. Furthermore, the manufacturers have to design different assembling procedures for various types of electric door locks, further increasing the costs.

BRIEF SUMMARY OF THE INVENTION

A modularized electric door lock according to the present invention includes an operating device having an inner unit and an outer unit. The operating device is configured to be set to a locked state or an unlocked state. An electric driving device is operatively connected to the operating device and can be operated to set the operating device to the locked state or the unlocked state. A latch is operatively connected to the operating device and is actuated by the operating device to move between a latching position and an unlatching position. An inner operating member is coupled to the inner unit of the operating device. Operation of the inner operating member actuates the operating device to move the latch between the latching position and the unlatching position. An outer operating member is coupled to the outer unit of the operating device. When the operating device is set to the unlocked state, operation of the outer operating member actuates the operating device to move the latch between the latching position and the unlatching position. When the operating device is set to the locked state, operation of the outer operating member does not actuate the operating device to move the latch from the latching position to the unlatching position. An inner assembling portion is coupled to the inner unit of the operating device. An inner electric device is detachably coupled to the inner assembling portion and is detachably and electrically connected to the electric driving device. An outer assembling portion is coupled to the outer unit of the operating device. An outer electric device is detachably and electrically connected to the inner electric device and is configured to input unlocking information to the inner electric device. The outer electric device is detachably coupled to the outer assembling portion. A power supply is detachably and electrically connected to the inner electric device.

In an example, the inner assembling portion includes an inner fixing member non-rotatably mounted to the inner unit of the operating device. The inner electric device is detachably coupled to the inner fixing member. The inner assembling portion further includes an inner cover having a through-hole and a mounting portion spaced from the through-hole. The inner operating member extends through the through-hole of the inner cover. The mounting portion includes an engagement side. The power supply includes at least one hook on a side thereof. The at least one hook of the power supply is detachably coupled to the engagement side of the mounting portion.

In an example, the inner cover further includes a receptacle. The power supply further includes a coupling groove aligned with the receptacle. The power supply further includes a through-hole extending from an outer surface thereof to the coupling groove. The modularized electric door lock further includes an engagement button slideably mounted in the receptacle. The engagement button is movable along a central axis of the receptacle between a front position partially outside of the receptacle and a rear position retracted into the receptacle. The engagement button in the front position engages with the coupling groove of the power supply to prevent the power supply from disengaging from the inner cover. The engagement button in the rear position disengages from the coupling groove of the power supply to permit disengagement of the power supply from the inner cover. When the power supply engages with the inner cover, the power supply is electrically connected to the inner electric device. When the power supply disengages from the inner cover, the power supply is not electrically connected to the inner electric device.

In an example, the inner fixing member further includes an engaging portion on a side thereof. The inner electric device further includes an engagement portion on a side thereof. The engagement portion of the inner electric device is detachably coupled to the engaging portion of the inner fixing member.

In an example, the power supply further includes two electrical connection portions and a battery electrically connected to the two electrical connection portions. The inner electric device further includes a first casing having a first groove and two second grooves, a first circuit board mounted in the first groove, and two terminal posts respectively mounted in the two second grooves. Each of the two electrical connection portions of the power supply is electrically connected to one of the two terminal posts.

In an example, the outer electric device includes an input portion. The input portion is one of a wireless transmitter, a keypad type input device, a touch screen, and a biological feature pickup device. The outer assembling portion includes an outer cover having a first hole and a second hole. The outer operating member extends through the first hole. The outer electric device is detachably coupled to the outer cover. The second hole receives the input portion of the outer electric device.

In an example, the operating device further includes an outer insertion groove in an outer periphery of the outer unit and an inner insertion groove in the inner unit and in communication with the outer insertion groove. The inner electric device includes a first socket. The outer electric device includes a second socket. A wire is received in the inner insertion groove and the outer insertion groove. The wire includes a first plug detachably and electrically connected to the first socket of the inner electric device and a second plug detachably and electrically connected to the second socket of the outer electric device.

In an example, the inner assembling portion includes an inner fixing member coupled to the inner unit of the operating device. The inner fixing member includes a coupling hole receiving the inner unit of the operating device. The coupling hole includes a protrusion on an inner periphery thereof. The protrusion engages with the inner insertion groove of the inner unit to prevent the inner fixing member from rotating relative to the operating device. The inner electric device is detachably coupled to the inner fixing member. The outer assembling portion includes an outer fixing member coupled to the outer unit of the operating device. The outer fixing member includes an engagement hole receiving the outer unit of the operating device. The engagement hole includes a tooth on an inner periphery thereof. The outer fixing member further includes two fixing rods extending from a side thereof and adapted to couple with a door. The outer fixing member is not rotatable relative to the door. The tooth of the outer fixing member engages with the outer insertion groove of the outer unit to prevent the outer fixing member from rotating relative to the operating device.

In an example, the door lock further includes an inner pressing ring threadedly engaged with the inner unit. The inner pressing ring includes a plurality of grooves in an outer periphery thereof. Two bolts extend through two of the plurality of grooves of the inner pressing ring and engage with the two fixing rods. The inner fixing member abuts a face of the inner pressing ring. An outer pressing ring is threadedly engaged with the outer unit. The outer pressing ring includes a plurality of recesses in a side thereof. The wire is received in one of the plurality of recesses. The outer pressing ring abuts the side of outer fixing member.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
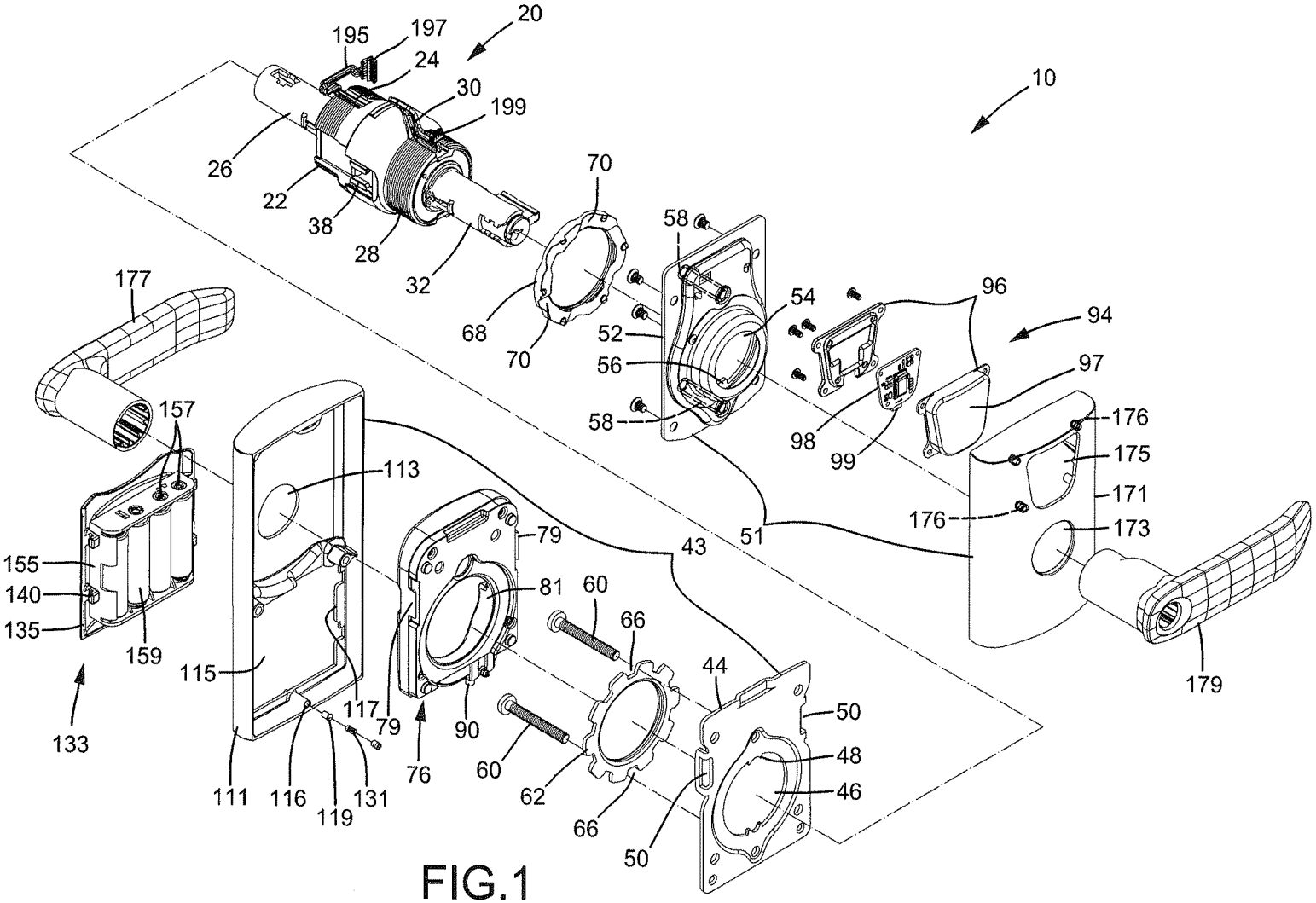
FIG. 1 is an exploded, perspective view of a modularized electric door lock according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "inner", "outer", "portion", "face", "side", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

Figure 9:
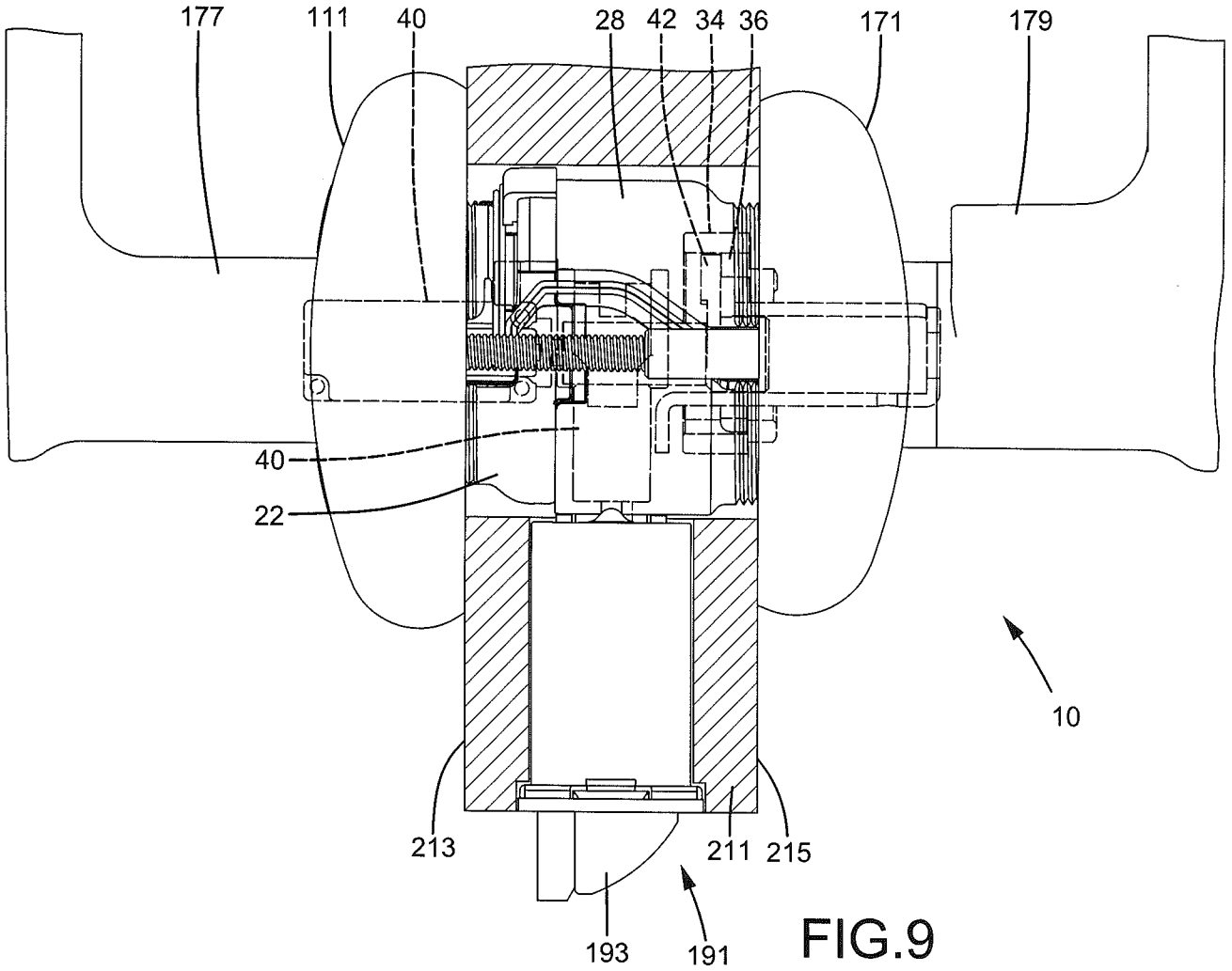
FIG. 9 is a view similar to FIG. 5, with a limiting member of an electric driving device in an unlocking position.

A modularized electric door lock (hereinafter referred to as "door lock") 10 according to the present invention is mounted to a door 211 (FIG. 5) having an inner face 213 and an outer face 215 opposite to inner face 213. Door lock 10 includes an operating device 20 having an inner unit 22 and an outer unit 28 assembled with the inner unit 22. Inner unit 22 includes an inner insertion groove 24 in an outer periphery thereof. Outer unit 28 includes an outer insertion groove 30 in an outer periphery thereof. Outer insertion groove 30 is intercommunicated with inner insertion groove 24. A retractor 38 is movably received in inner unit 22 and outer unit 28. An inner spindle 26 is pivotably mounted in inner unit 22 and is coupled to and jointly movable with retractor 38. An outer spindle 32 is pivotably mounted in outer unit 28 and is coupled to and jointly movable with retractor 38. Operating device 20 further includes a sleeve 34 fixed in inner unit 22 and having a limiting groove 36. Operating device 20 further includes an electric driving device 40 mounted between inner unit 22 and outer unit 28 and operatively connected to operating device 20. Electric driving device 40 includes a limiting member 42 movable between a locking position (FIG. 5) in limiting groove 36 and an unlocking position (FIG. 9) outside of limiting groove 36. When electric driving device 40 is in the locking position, operating device 20 is set to a locked state. When electric driving device 40 is in the unlocking position, operating device 20 is set to the unlocked state.

Figure 5:
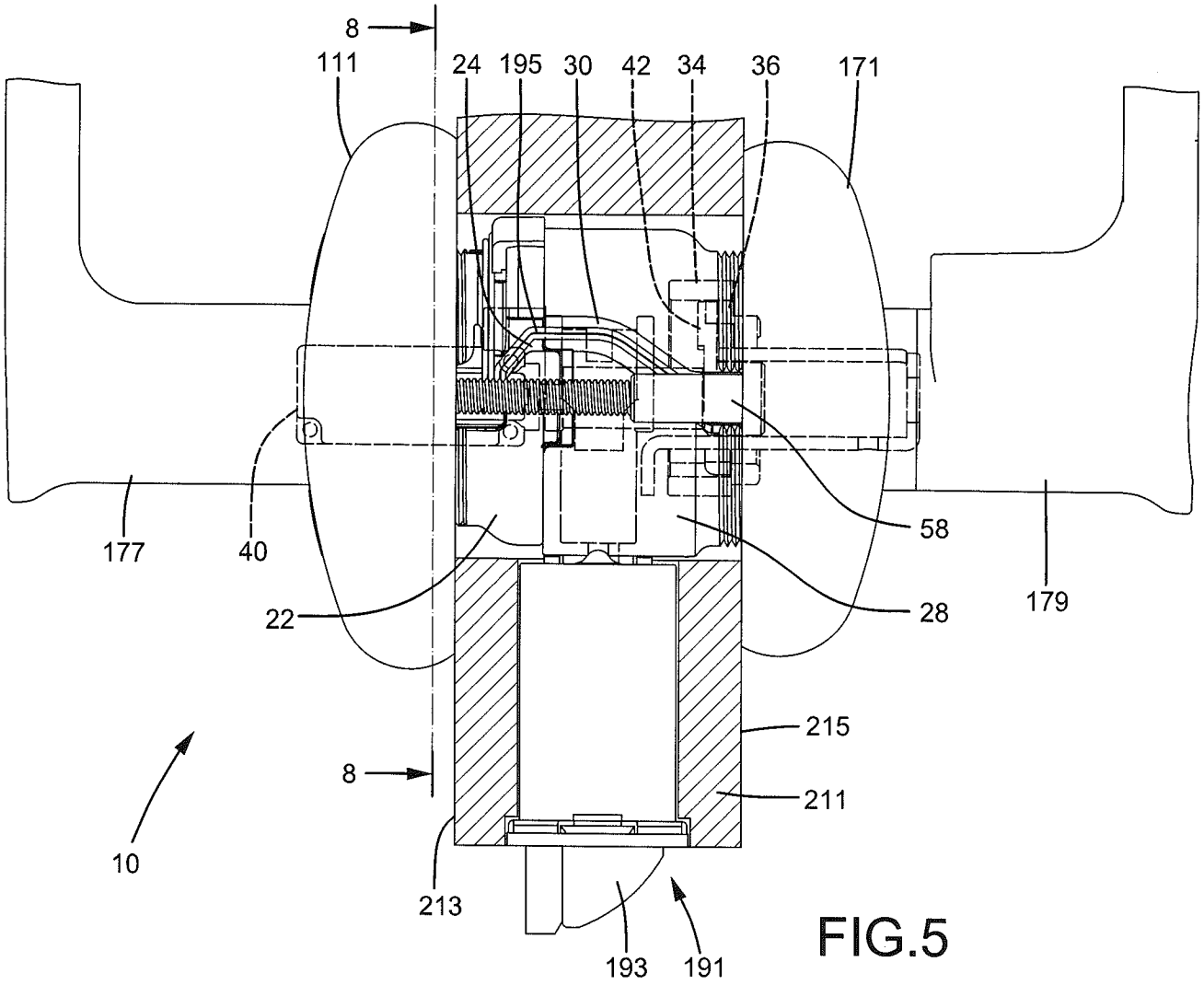
FIG. 5 is a partly-cross sectioned top view of the modularized electric door lock of FIG. 4B.
Figure 6:
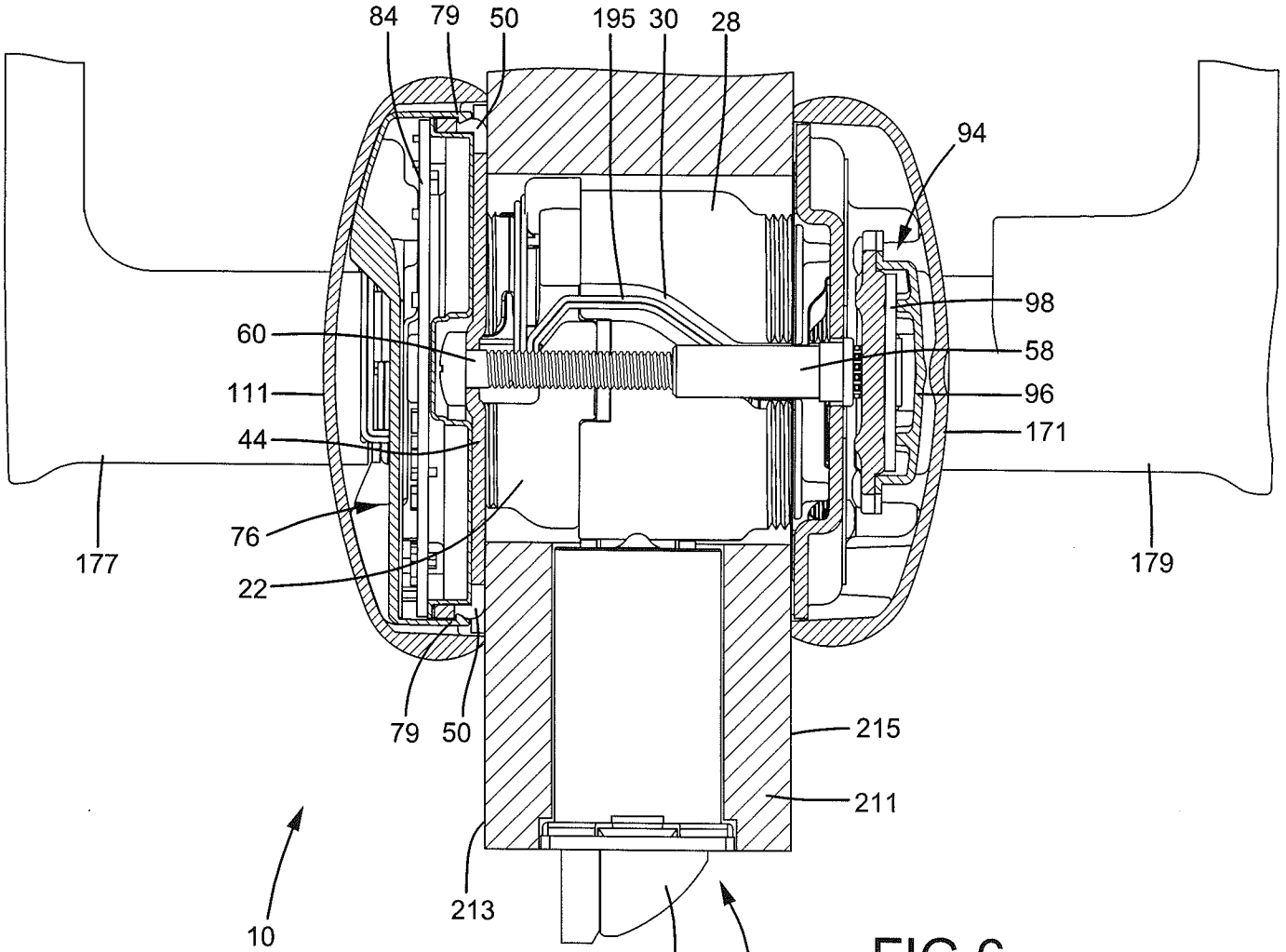
FIG. 6 is a cross sectional view taken along section line 6-6 of FIG. 4B.

With reference to FIG. 5, operating device 20 is mounted to door 211. A portion of inner unit 22 and a portion of inner spindle 26 are located outside of inner face 213 of door 211. A portion of outer unit 28 and a portion of outer spindle 32 are located outside of outer face 215 of door 211.

Door lock 10 further includes an inner assembling portion 43 engaged with inner unit 22 of operating device 20. Inner assembling portion 43 includes an inner fixing member 44 non-rotatably mounted around inner unit 22. Inner fixing member 44 includes a coupling hole 46 receiving inner unit 22 and a protrusion 48 formed on an inner periphery of coupling hole 46. Inner fixing member 44 further includes two engaging portions 50 (in the form of slots in this example) respectively on two sides thereof. Protrusion 48 of inner fixing member 44 engages with inner insertion groove 24 of inner unit 22, such that inner fixing member 44 cannot rotate relative to inner unit 22.

Inner assembling portion 43 further includes an inner cover 111 mounted to an outer side of inner fixing member 44. Inner cover 111 includes a through-hole 113 and a mounting portion 115 spaced from through-hole 113. Inner cover 111 further includes a receptacle 116 below mounting portion 115. Inner cover 111 is securely mounted around inner fixing member 44. Through-hole 113 is aligned with a central portion of coupling hole 46.

Figure 10:
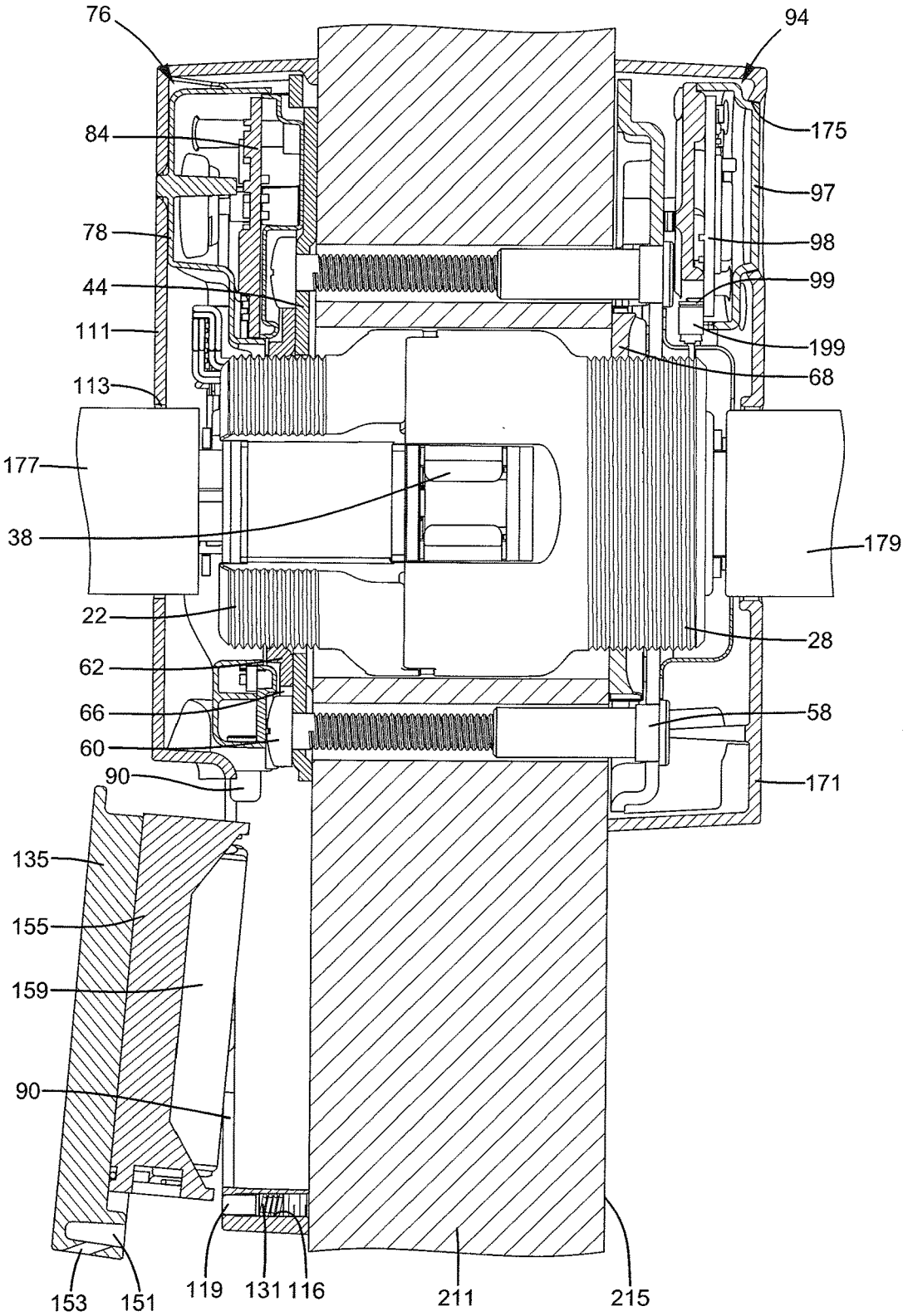
FIG. 10 is a view similar to FIG. 7, with a coupling button in a rear position for detaching a power supply.

An engagement button 119 and a spring 131 (FIG. 7) are slideably received in receptacle 116. Engagement button 119 is movable along a central axis of receptacle 116 between a front position (FIG. 7) partially outside of receptacle 116 of inner cover 111 and a rear position (FIG. 10) retracted into receptacle 116 of inner cover 111. Spring 131 biases engagement button 119 to the front position.

Door lock 10 further includes an outer assembling portion 51 engaged with outer unit 28 of operating device 20. Outer assembling portion 51 includes an outer fixing member 52 and an outer cover 171. Outer fixing member 52 includes an engagement hole 54 and a tooth 56 on an inner periphery of engagement hole 54. Outer fixing member 52 further includes two fixing rods 58 on a side thereof. Outer fixing member 52 is mounted around outer unit 28. Tooth 56 engages with outer insertion groove 30 of outer unit 28, such that outer fixing member 52 cannot rotate relative to operating device 20. Furthermore, fixing rods 58 extend into door 211, such that operating device 20 cannot rotate relative to door 211.

Outer assembling portion 51 further includes an outer cover 171 having a first hole 173 and a second hole 175. Outer cover 171 further includes a plurality of mounting pegs 176 on an inner face thereof. Outer cover 171 is mounted to an outer side of outer fixing member 52. First hole 173 is aligned with a central portion of engagement hole 54.

Door lock 10 further includes an inner pressing ring 62 threadedly coupled to inner unit 22 of operating device 20 and an outer pressing ring 68 threadedly coupled to outer unit 28. Inner pressing ring 62 includes a plurality of grooves 66 in an outer periphery thereof and abuts a side of inner fixing member 44. Outer pressing ring 68 includes a plurality of recesses 70 in a side thereof and abuts a side of outer fixing member 52. Furthermore, two bolts 60 extend through inner fixing member 44 and two grooves 66 of inner pressing ring 62 and into two holes respectively in the two fixing rods 58. Rotation and loosening of inner pressing ring 62 are prevented.

Figure 2:
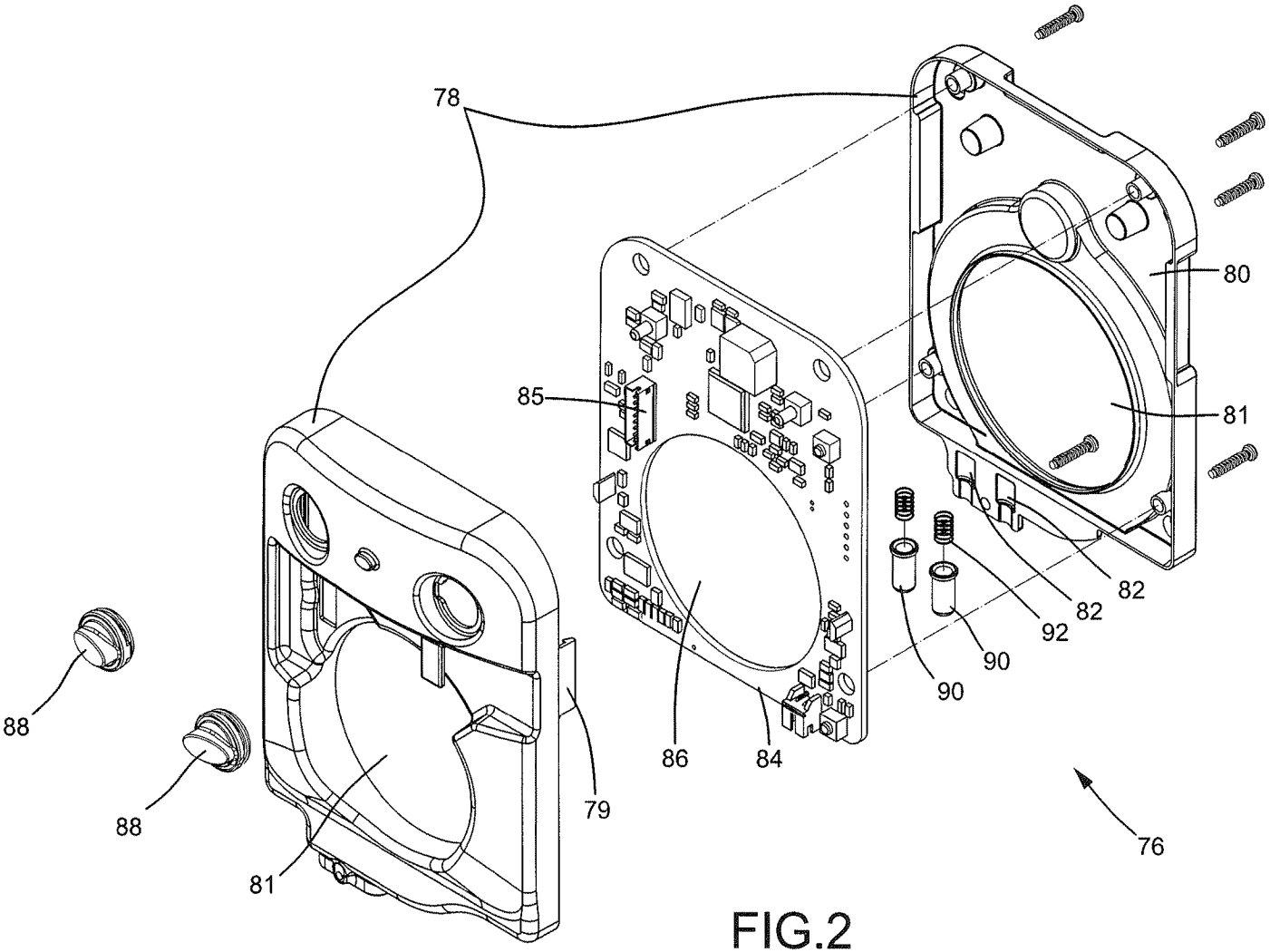
FIG. 2 is an exploded, perspective view of an inner electric device of the modularized electric door lock of FIG. 1.

With reference to FIG. 2, door lock 10 further includes an inner electric device 76 detachably mounted to inner fixing member 44. Inner electric device 76 includes a first casing 78 having a through-hole 81. First casing 78 further includes a first groove 80 outside of through-hole 81 and two second grooves 82 below first groove 80. First casing 78 further includes two engagement portions 79 (in the form of hooks in this example) respectively on two sides thereof.

Inner electric device 76 further includes a first circuit board 84 received in first groove 80 and an opening 86 aligned with through-hole 81. Inner electric device 76 further includes a first socket 85 electrically connected to first circuit board 84 and exposed to an outer side of first casing 78. Two terminal posts 90 are respectively received in the two second grooves 82 of the first casing 78 and are electrically connected to first circuit board 84. Two springs 92 are respectively received in the two second grooves 82 and bias the two terminal posts 90 to the outer side of the first casing 78. Furthermore, two operation buttons 88 are mounted to a surface of first casing 78 for manual pressing to control first circuit board 84.

The two engagement portions 79 of inner electric device 76 are detachably and respectively engaged with the engaging portions 50 of inner fixing member 44. The centers of through-hole 81, opening 86, and coupling hole 46 are aligned with each other. Inner unit 22 of operating device 20 is received in through-hole 81, opening 86, and coupling hole 46. The two terminal posts 90 are located in mounting portion 115.

Figure 3:
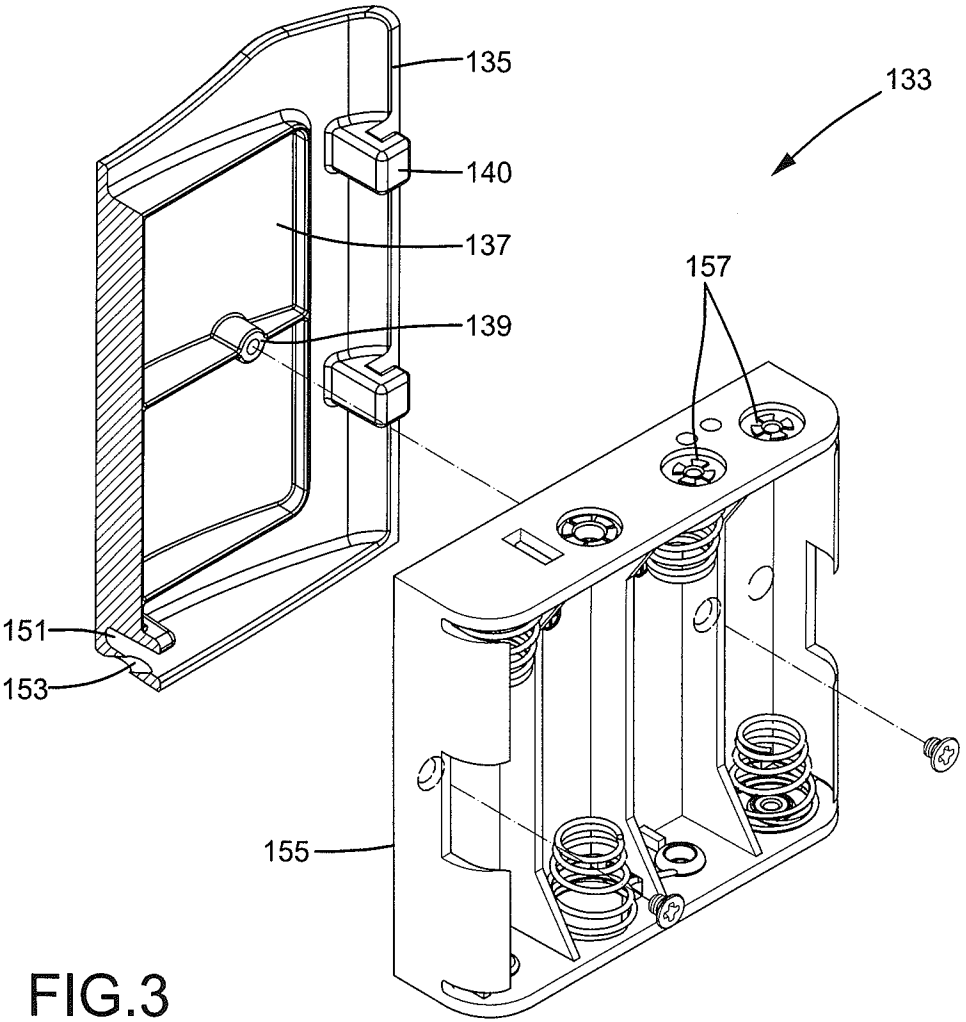
FIG. 3 is an exploded, perspective view of a power supply of the modularized electric door lock of FIG. 1.

With reference to FIGS. 1 and 3, door lock 10 further includes a power supply 133 detachably coupled to inner cover 111. Power supply 133 includes a cover 135 and a battery seat 155 assembled with cover 135 to form a module. Cover 135 includes an inner surface 137 having a plurality of engagement portions 139. Cover 135 further includes a plurality of hooks 140 on two sides of inner surface 137. Cover 135 further includes a coupling groove 151 in inner surface 137 and a through-hole 153 in a bottom thereof. Through-hole 153 is an inclined hole extending from an outer surface of cover 135 to coupling groove 151. Battery seat 155 is screwed to engagement portions 139 of cover 135 and includes two electrical connecting portions 157 on a top face thereof. A plurality of batteries 159 is received in battery seat 155 and is electrically connected to the two electrical connecting portions 157.

Figure 7:
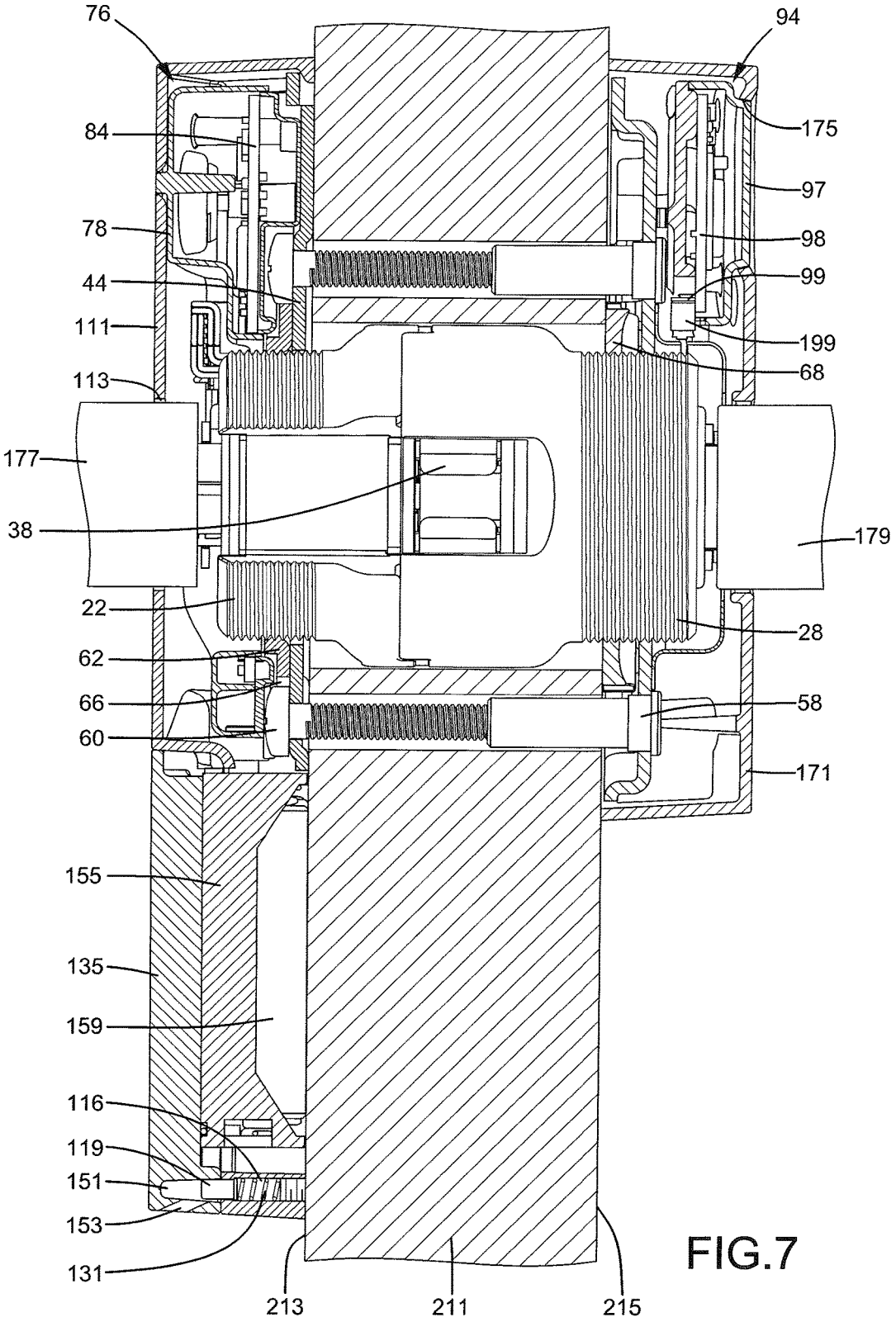
FIG. 7 is a cross sectional view taken along section line 7-7 of FIG. 4B.
Figure 8:
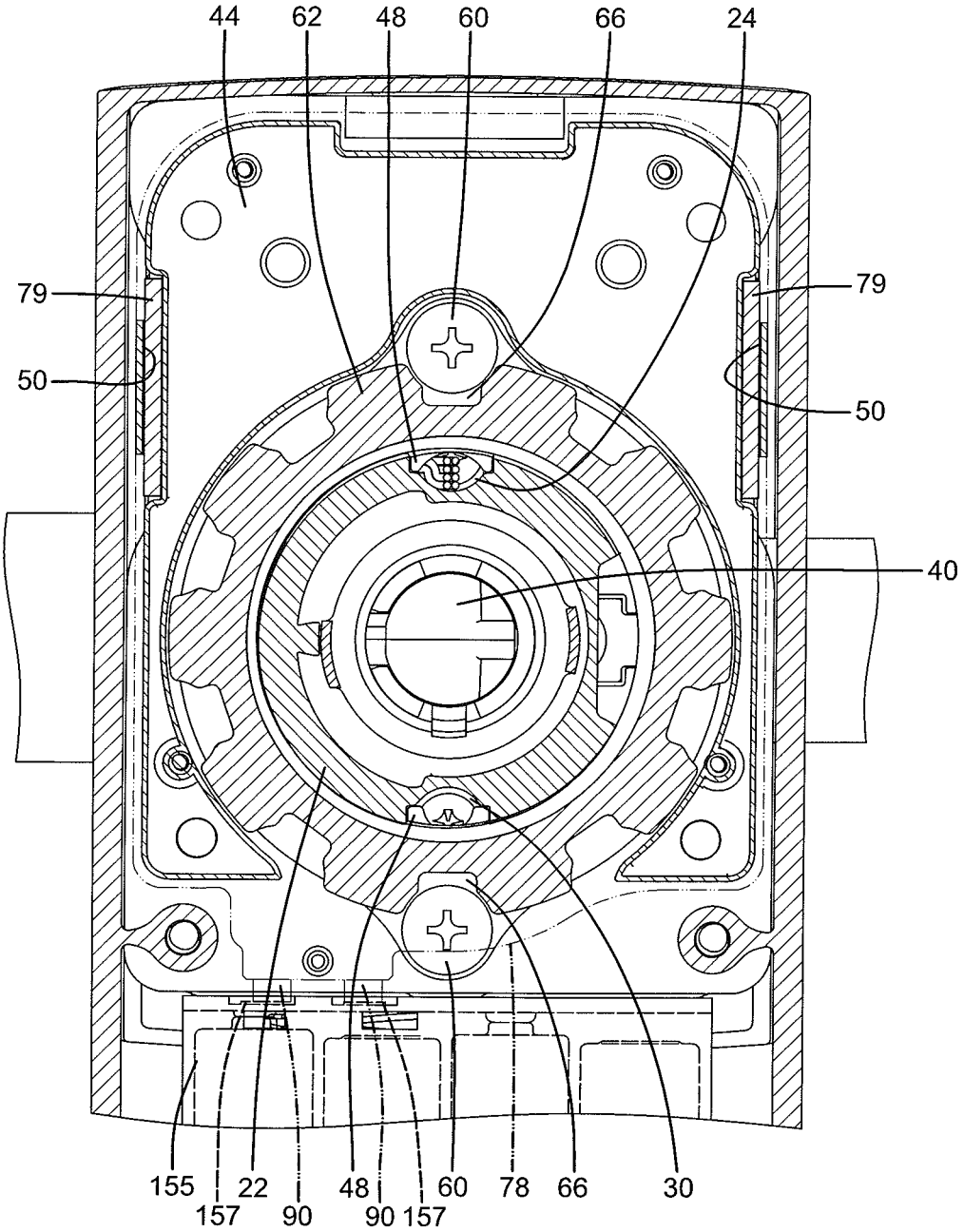
FIG. 8 is a cross sectional view taken along section line 8-8 of FIG. 5.

Each hook 140 of cover 135 of power supply 133 is detachably coupled with one engagement side 117 of inner cover 111. Coupling groove 151 is aligned with receptacle 116. Thus, an end of engagement button 119 is located in coupling groove 151 of cover 135 (FIG. 7). Each electrical connecting portion 157 of power supply 133 is electrically connected to one terminal post 90 of inner electric device 76 (FIG. 8). Thus, power supply 133 is detachably assembled in inner cover 111 to supply electricity required for operation of inner electric device 76.

Door lock 10 further includes an outer electric device 94 detachably mounted to outer cover 171. Outer electric device 94 includes a second casing 96 having a second socket 99 and a second circuit board 98 received in second casing 96. Outer electric device 94 further includes an input portion 97 for receiving or inputting unlocking information. Input portion 97 of outer electric device 94 is exposed via second hole 175 of outer cover 171. Outer electric device 94 is detachably coupled to mounting pegs 176 of outer cover 171 by screws.

Input portion 97 of outer electric device 94 can be a wireless transmitter, a keypad type input device, a touch screen, or a biological feature pickup device. The wireless transmitter can be one of radio frequency identification (RFID), near field communication (NFC), Bluetooth, and WI-FI. The keypad type input device can be a digital coded access keypad. The biological feature pickup device can be one of fingerprint pickup device, an iris recognition device, a finger vein pickup device, and a facial recognition system.

Figure 4A:
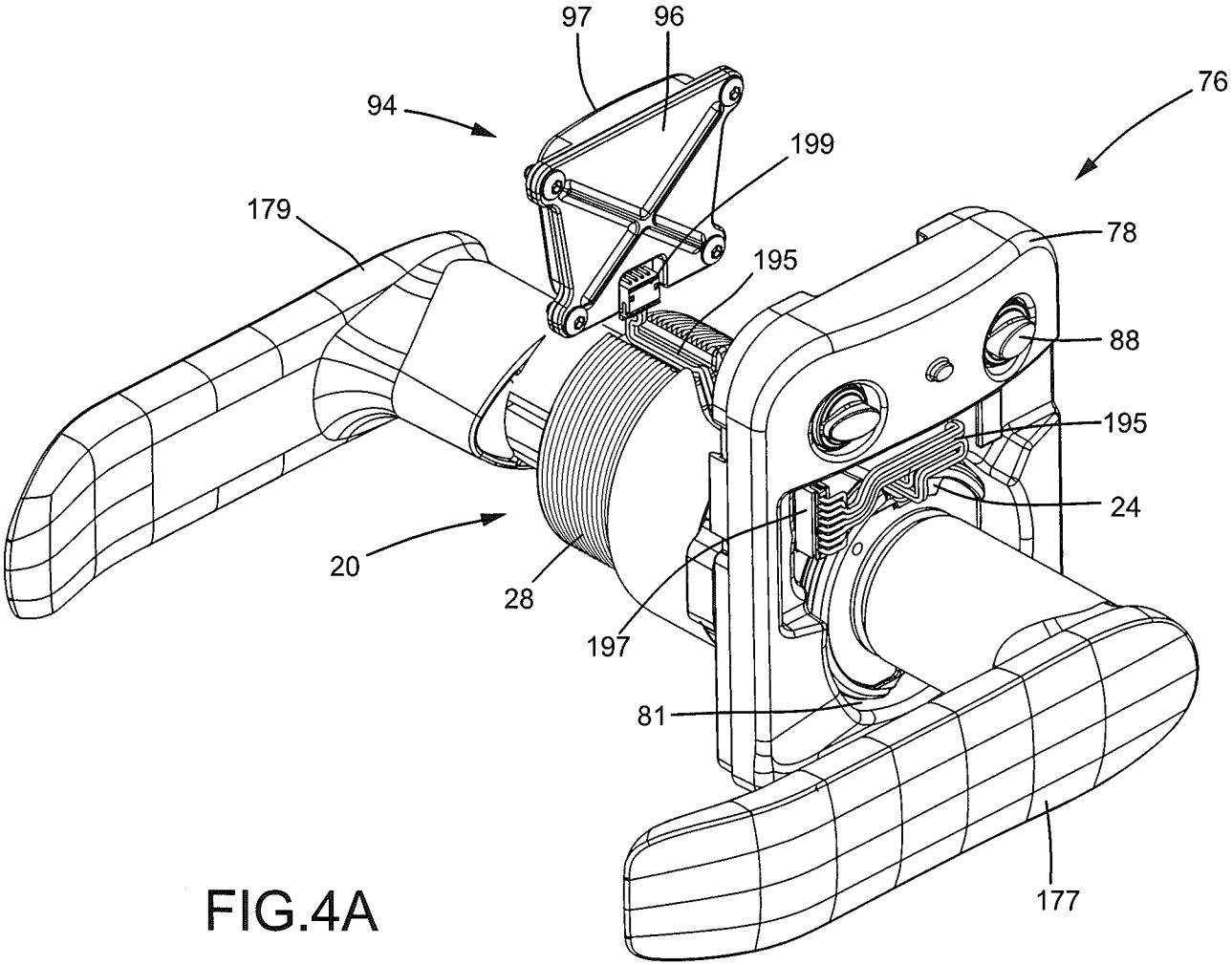
FIG. 4A is a diagrammatic view illustrating connection of the inner electric device and an outer electric device of the modularized electric door lock of FIG. 1.
Figure 4B:
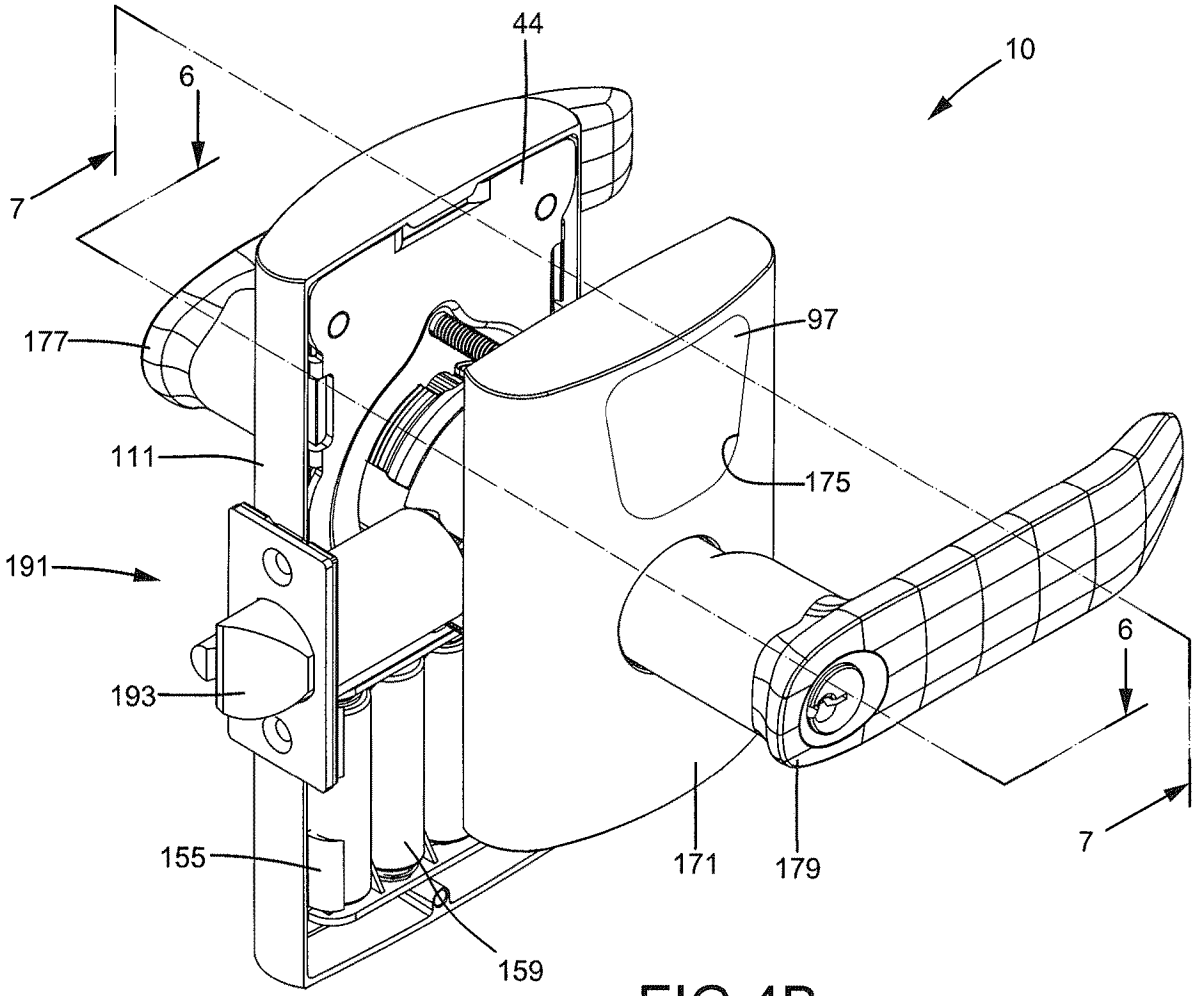
FIG. 4B is a perspective view of the modularized electric door lock of FIG. 1 after assembly.

With reference to FIG. 4A, inner electric device 76 and outer electric device 94 are electrically connected by a wire 195. Wire 195 includes a first plug 197 electrically connected to first socket 85 of first circuit board 84 and a second plug 199 electrically connected to second plug 99 of second circuit board 98. Wire 195 extends into operating device 20 and is electrically connected to electric driving device 40. A portion of wire 195 is received in inner insertion groove 24 of inner unit 22 and outer insertion groove 30 of outer unit 28. Furthermore, protrusion 48 of inner fixing member 44 is spaced from a bottom of inner insertion groove 24 of inner unit 22, providing a space through which wire 195 extends. Tooth 56 of outer fixing member 52 is spaced from a bottom of outer insertion groove 30 of outer unit 28, providing a space through which wire 195 extends.

Inner electric device 76 and outer electric device 94 are electrically connected via wire 195. Inner electric device 76 can control operation of outer electric device 94, such as driving outer electric device 94 to transmit signals and/or to receive unlocking information (such as by RFID). The unlocking signal received by outer electric device 94 is sent to inner electric device 76 for identifying whether the unlocking signal is correct. The inner electric device 76 controls operation of electric driving device 40 based on the identification result of the unlocking signal, thereby setting operating device 20 to the locked state or unlocked state.

Door lock 10 further includes an inner operating member 177 (in the form of a handle in this example) and an outer operating member 179 (in the form of a handle in this example). Inner operating member 177 extends through through-hole 113 of inner cover 111 and is coupled to and jointly pivotable with inner spindle 26. Outer operating member 179 extends through first hole 173 of outer cover 171 and is coupled to and jointly pivotable with outer spindle 32. Inner operating member 177 can be independently pivoted to cause movement of retractor 38 via inner spindle 26. Outer operating member 179 can be independently pivoted to cause movement of retractor 38 via outer spindle 32.

Door lock 10 further includes a latch device 191 mounted to an end face of door 211 and operatively coupled to retractor 38. Door lock 191 includes a latch 193 movable between a latching position extending beyond the end face of door 211 and an unlatching position retracted into the end face of door 211.

For ease of explanation, it is assumed that outer electric device 94 uses RFID, and first circuit board 84 of inner electric device 76 cooperating with outer electric device 94 is capable of controlling RFID. When operating device 20 is set to the locked state (FIG. 5), latch 193 is in the latching position, such that limiting member 42 of electric driving device 40 is in the locking position. Thus, limiting member 42 engages with limiting groove 36 of sleeve 34. Outer spindle 32 of outer unit 28 cannot be pivoted by operating outer operating member 179. As a result, latch 193 cannot be moved from the latching position to the unlatching position by operating outer operating member 179. Consequently, door 211 cannot be opened from the outside when door lock 10 is set to the locked state. Nevertheless, inner operating member 177 can be operated to pivot inner spindle 26 for actuating retractor 38, which, in turn, moves latch 193 from the latching position to the unlatching position, thereby permitting opening of door 211 from the inside.

When it is desired to set operating device 20 to the unlocked state, in an example, a door access card is placed in a location adjacent to input portion 97 of outer electric device 94. Input portion 97 of outer electric device 94 reads the unlocking information in the door access card and sends the unlocking information to inner electric device 76 for identification. If inner electric device 76 identifies that the unlocking information is incorrect or does not match any data in an access list granted with door access authority, limiting member 42 of electric driving device 40 remains in the locking position, and operating device 20 remains in the locked state. On the other hand, if inner electric device 76 identifies that the unlocking information is correct or matches data in the access list granted with door access authority, inner electric device 76 outputs an unlocking signal to electric driving device 40, such that limiting member 42 of electric driving device 40 moves from the locking position to the unlocking position, and limiting member 42 disengages from limiting groove 36 of sleeve 34. Thus, operating device 20 is set to the unlocked state.

When operating device 20 is set to the unlocked state, pivotal movement of outer operating member 179 causes outer spindle 32 to actuate retractor 38, which, in turn, moves latch 193 from the latching position to the unlatching position, permitting opening of door 211 from the outside. Door 211 can also be opened by operating inner operating member 177 when operating device 20 is set to the unlocked state.

If the electricity of power supply 133 is insufficient, a long, thin tool can be used to extend through through-hole 153 of cover 135 of power supply 133 to press engagement button 119, disengaging engagement button 119 from coupling groove 151 of cover 135. Thus, power supply 133 can be detached (FIG. 10) for subsequent replacement of a new battery 159.

Figure 11:
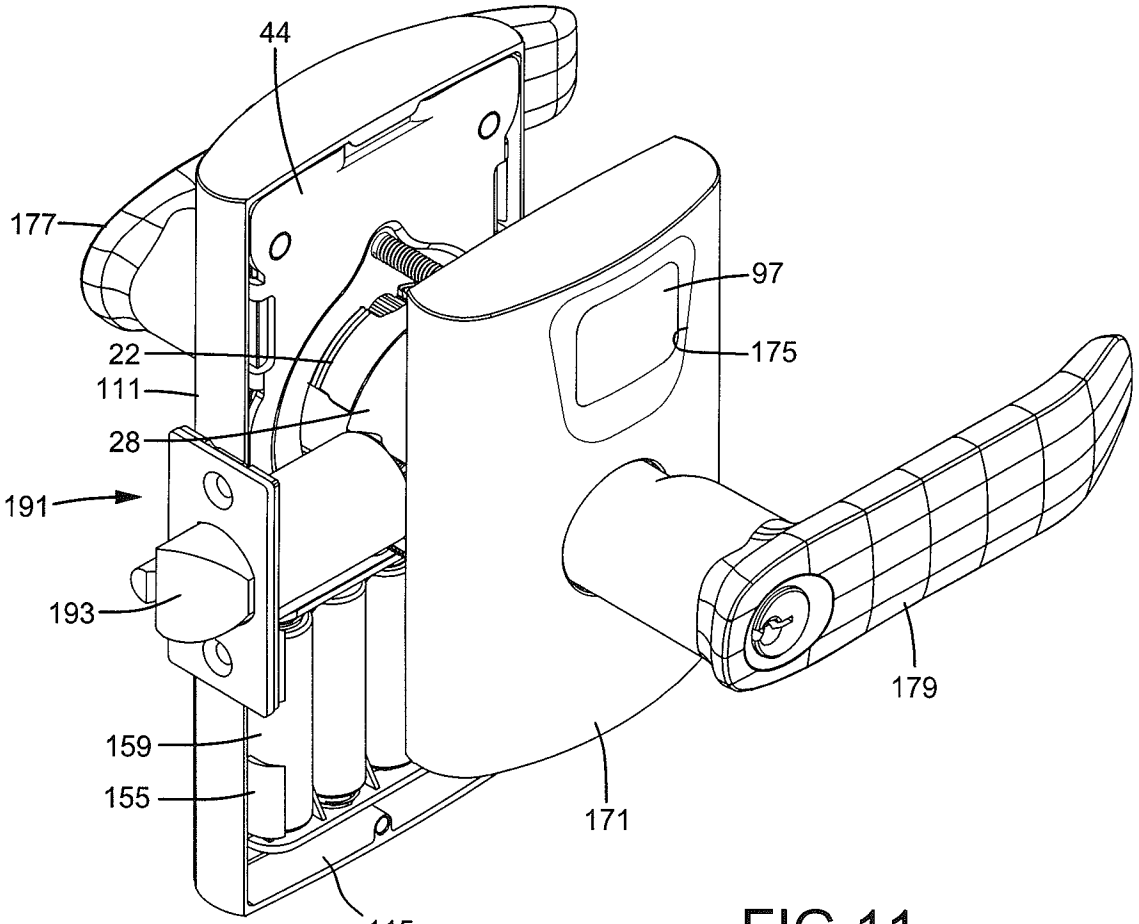
FIG. 11 is a diagrammatic perspective view of a modularized electric door lock using an outer electric device having a touch screen.

Modularized electric door lock 10 can be rapidly assembled. Furthermore, outer electric device 94 and inner electric device 76 cooperating with outer electric device 94 can be rapidly replaced, such that door lock 10 can be assembled into different types according to various needs. In the embodiment shown in FIGS. 1-10, door lock 10 uses outer electric device 94 with an RFID function. When it is desired to use an outer electric device 94 with a touch screen, it is not necessary to replace outer operating device 20. Instead, the outer electric device 94 with a touch screen is mounted to outer cover 171. The touch screen is located in input portion 97 of outer electric device 94, such that the touch screen is exposed via second hole 175 of outer cover 171. Then, an inner electric device 76 capable of controlling outer electric device 94 with the touch screen can be assembled to inner fixing member 44. The resultant door lock 10 permits input of the unlocking information through the touch screen (see FIG. 11) which can be used to input a pin number or a figure.

Figure 12:
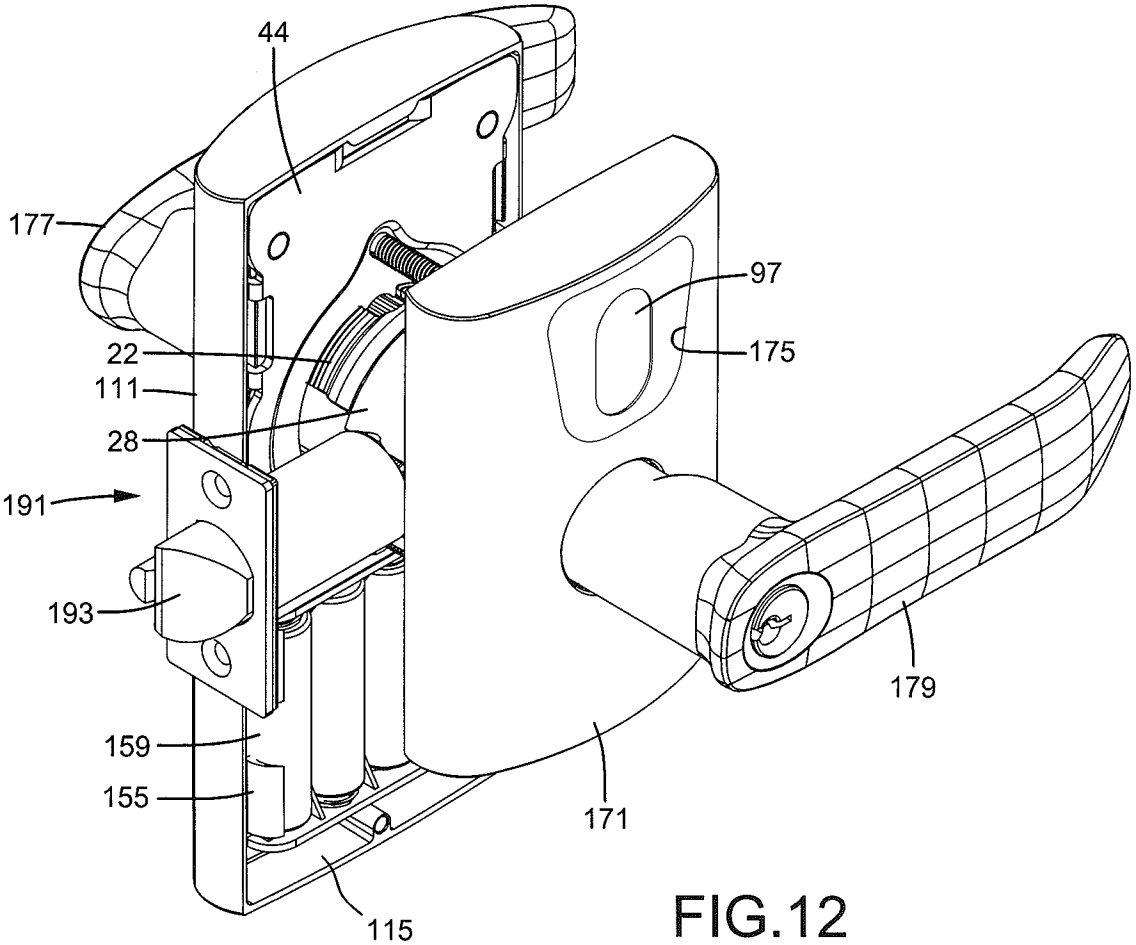
FIG. 12 is a diagrammatic perspective view of a modularized electric door lock using an outer electric device having a biological feature pickup device.

With reference to FIG. 12, when outer electric device 94 including a fingerprint pickup device is used, first circuit board 84 of inner electric device 76 is configured to control the fingerprint pickup device. Thus, door lock 10 can be rapidly assembled to a type using fingerprints for unlocking purposes. Namely, fingerprints can be inputted and used as the unlocking information for setting operating device 20 to the unlocked state.

Figure 13:
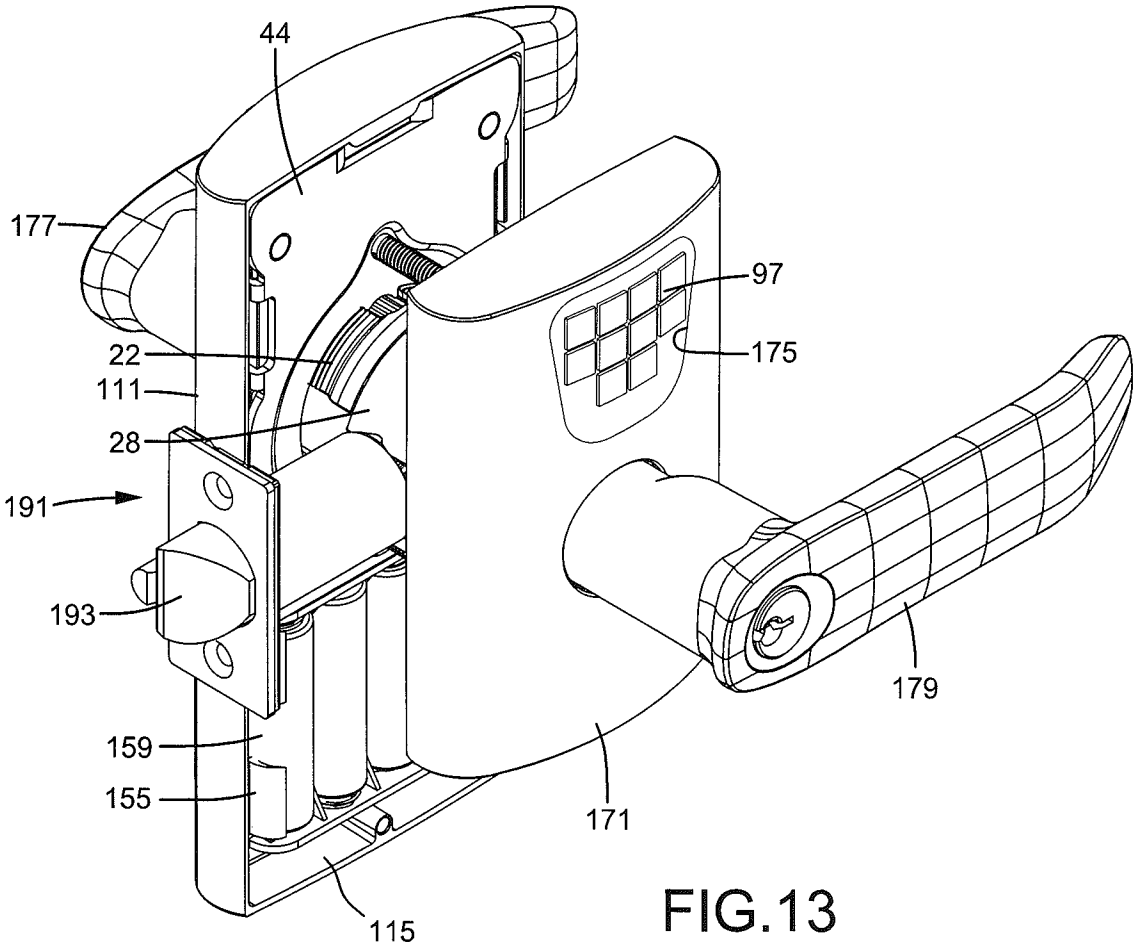
FIG. 13 is a diagrammatic perspective view of a modularized electric door lock using an outer electric device having a keypad type input device.

With reference to FIG. 13, when outer electric device 94 including a keypad type input device having a digital coded access keypad is used, first circuit board 84 of inner electric device 76 is configured to control the keypad type input device. Thus, door lock 10 can be rapidly assembled to a type using the digital coded access keypad for inputting a pin number for unlocking purposes. Namely, a preset code can be inputted and used as the unlocking information for setting operating device 20 to the unlocked state.

By simply replacing inner and outer electric devices 76 and 94 without changing the other components, door lock 10 can be converted into different types according to various needs. The assembling procedure of door lock 10 can be accomplished rapidly while effectively reducing the costs of the manufacturer.

Furthermore, inner fixing member 44 is non-rotatably coupled to inner unit 22, and outer fixing member 52 is non-rotatably coupled to outer unit 28. Furthermore, outer fixing member 52 is fixed by fixing rods 58 to door 211, and two bolts 60 are used to engage with the two fixing rods 58 and extend through two grooves 66 of inner pressing ring 62. Thus, the anti-torque strength of operating device 20 is effectively increased. As a result, door lock 10 has sufficient engaging strength after door lock 10 is mounted to door 211.

Now that the basic teachings of the present invention have been explained, many extensions and variations will be obvious to one having ordinary skill in the art. For example, electric driving device 40 can be a device using a motor, a speed reduction mechanism, and a screw rod mechanism for moving limiting member 42, an example of which is disclosed in U.S. Pat. No. 9,435,143, the entire contents of which are incorporated herein by reference. Furthermore, electric driving device 40 can use an electromagnetic valve to drive limiting member 42. Furthermore, door lock 10 can include only one fixing rod 58.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A modularized electric door comprising:

an operating device including an inner unit having an inner spindle and an outer unit having an outer spindle, with the operating device configured to be set to a locked state or an unlocked state;

an electric driving device operatively connected to the operating device, with the electric driving device operable to set the operating device to the locked state or the unlocked state;

a latch operatively connected to the inner spindle and the outer spindle of the operating device, with the operating device actuating the latch to move between a latching position and an unlatching position;

an inner operating member coupled to the inner spindle, wherein operation of the inner operating member actuates the inner spindle to move the latch between the latching position and the unlatching position;

an outer operating member coupled to the outer spindle, wherein when the operating device is set to the unlocked state, operation of the outer operating member actuates the outer spindle to move the latch between the latching position and the unlatching position, and wherein when the operating device is set to the locked state, operation of the outer operating member does not actuate the operating device to move the latch from the latching position to the unlatching position;

an inner assembling portion coupled to the inner unit of the operating device;

an inner electric device detachably coupled to the inner assembling portion and detachably and electrically connected to the electric driving device;

an outer assembling portion coupled to the outer unit of the operating device;

an outer electric device detachably and electrically connected to the inner electric device and configured to input unlocking information to the inner electric device, with the outer electric device detachably coupled to the outer assembling portion; and a power supply detachably and electrically connected to the inner electric device, with the inner assembling portion including an inner fixing member non-rotatably mounted to the inner unit of the operating device, with the inner electric device detachably coupled to the inner fixing member, with the inner assembling portion further including an inner cover having a through-hole and a mounting portion spaced from the through-hole, with the inner operating member extending through the through-hole of the inner cover, with the mounting portion including an engagement side, with the power supply including at least one hook on a side thereof, and with the at least one hook of the power supply detachably coupled to the engagement side of the mounting portion, with the inner cover further including a receptacle, with the power supply further including a coupling groove aligned with the receptacle, with the power supply further including a through-hole extending from an outer surface thereof to the coupling groove, with the modularized electric door lock further comprising:

an engagement button slideably mounted in the receptacle, with the engagement button movable along a central axis of the receptacle between a front position partially outside of the receptacle and a rear position retracted into the receptacle, wherein the engagement button in the front position engages with the coupling groove of the power supply to prevent the power supply from disengaging from the inner cover, and wherein the engagement button in the rear position disengages from the coupling groove of the power supply to permit disengagement of the power supply from the inner cover, with the power supply engaged with the inner cover, the power supply is electrically connected to the inner electric device, and with the power supply disengaged from the inner cover, the power supply is not electrically connected to the inner electric device.

2. The modularized electric door lock as claimed in claim 1, with the outer electric device including an input portion, with the input portion being one of a wireless transmitter, a keypad type input device, a touch screen, and a biological feature pickup device, with the outer assembling portion including an outer cover having a first hole and a second hole, with the outer operating member extending through the first hole, with the outer electric device detachably coupled to the outer cover, and with the second hole receiving the input portion of the outer electric device.

3. The modularized electric door lock as claimed in claim 1, with the operating device further including an outer insertion groove in an outer periphery of the outer unit and an inner insertion groove in the inner unit and in communication with the outer insertion groove, with the inner electric device including a first socket, with the outer electric device including a second socket, with a wire received in the inner insertion groove and the outer insertion groove, with the wire including a first plug detachably and electrically connected to the first socket of the inner electric device and a second plug detachably and electrically connected to the second socket of the outer electric device.

4. A modularized electric door lock comprising:

an operating device including an inner unit having an inner spindle and an outer unit having an outer spindle, with the operating device configured to be set to a locked state or an unlocked state;

an electric driving device operatively connected to the operating device, with the electric driving device operable to set the operating device to the locked state or the unlocked state;

a latch operatively connected to the inner spindle and the outer spindle of the operating device, with the operating device actuating the latch to move between a latching position and an unlatching position;

an inner operating member coupled to the inner spindle, wherein operation of the inner operating member actuates the inner spindle to move the latch between the latching position and the unlatching position;

an outer operating member coupled to the outer spindle, wherein when the operating device is set to the unlocked state, operation of the outer operating member actuates the outer spindle to move the latch between the latching position and the unlatching position, and wherein when the operating device is set to the locked state, operation of the outer operating member does not actuate the operating device to move the latch from the latching position to the unlatching position;

an inner assembling portion coupled to the inner unit of the operating device;

an inner electric device detachably coupled to the inner assembling portion and detachably and electrically connected to the electric driving device;

an outer assembling portion coupled to the outer unit of the operating device;

an outer electric device detachably and electrically connected to the inner electric device and configured to input unlocking information to the inner electric device, with the outer electric device detachably coupled to the outer assembling portion; and a power supply detachably and electrically connected to the inner electric device, with the power supply further including two electrical connection portions and a battery electrically connected to the two electrical connection portions, with the inner electric device further including:

a first casing including a first groove and two second grooves;

a first circuit board mounted in the first groove; and two terminal posts respectively mounted in the two second grooves, with each of the two electrical connection portions of the power supply electrically connected to one of the two terminal posts.

5. The modularized electric door lock as claimed in claim 4, with the inner assembling portion including:

an inner fixing member non-rotatably mounted to the inner unit of the operating device, with the inner electric device detachably coupled to the inner fixing member; and an inner cover including a through-hole and a mounting portion spaced from the through-hole, with the inner operating member extending through the through-hole of the inner cover, with the mounting portion including an engagement side, with the power supply including at least one hook on a side thereof, and with the at least one hook of the power supply detachably coupled to the engagement side of the mounting portion.

6. The modularized electric door lock as claimed in claim 5, with the inner cover further including a receptacle, with the power supply further including a coupling groove aligned with the receptacle, with the power supply further including a through-hole extending from an outer surface thereof to the coupling groove, with the modularized electric door lock further comprising:

an engagement button slideably mounted in the receptacle, with the engagement button movable along a central axis of the receptacle between a front position partially outside of the receptacle and a rear position retracted into the receptacle, wherein the engagement button in the front position engages with the coupling groove of the power supply to prevent the power supply from disengaging from the inner cover, and wherein the engagement button in the rear position disengages from the coupling groove of the power supply to permit disengagement of the power supply from the inner cover, with the power supply engaged with the inner cover, the power supply is electrically connected to the inner electric device, and with the power supply disengaged from the inner cover, the power supply is not electrically connected to the inner electric device.

7. The modularized electric door lock as claimed in claim 5, with the inner fixing member further including an engaging portion on a side thereof, with the inner electric device further including an engagement portion on a side thereof, with the engagement portion of the inner electric device detachably coupled to the engaging portion of the inner fixing member.

8. The modularized electric door lock as claimed in claim 4, with the outer electric device including an input portion, with the input portion being one of a wireless transmitter, a keypad type input device, a touch screen, and a biological feature pickup device, with the outer assembling portion including an outer cover having a first hole and a second hole, with the outer operating member extending through the first hole, with the outer electric device detachably coupled to the outer cover, and with the second hole receiving the input portion of the outer electric device.

9. The modularized electric door lock as claimed in claim 4, with the operating device further including an outer insertion groove in an outer periphery of the outer unit and an inner insertion groove in the inner unit and in communication with the outer insertion groove, with the inner electric device including a first socket, with the outer electric device including a second socket, with a wire received in the inner insertion groove and the outer insertion groove, with the wire including a first plug detachably and electrically connected to the first socket of the inner electric device and a second plug detachably and electrically connected to the second socket of the outer electric device.

10. The modularized electric door lock as claimed in claim 9, with the inner assembling portion including an inner fixing member coupled to the inner unit of the operating device, with the inner fixing member including a coupling hole receiving the inner unit of the operating device, with the coupling hole including a protrusion on an inner periphery thereof, with the protrusion engaged with the inner insertion groove of the inner unit to prevent the inner fixing member from rotating relative to the operating device, with the inner electric device detachably coupled to the inner fixing member, with the outer assembling portion including an outer fixing member coupled to the outer unit of the operating device, with the outer fixing member including an engagement hole receiving the outer unit of the operating device, with the engagement hole including a tooth on an inner periphery thereof, with the outer fixing member further including two fixing rods extending from a side thereof and adapted to couple with a door, with the outer fixing member being not rotatable relative to the door, and with the tooth of the outer fixing member engaged with the outer insertion groove of the outer unit to prevent the outer fixing member from rotating relative to the operating device.

11. The door lock as claimed in claim 10, further comprising:

an inner pressing ring threadedly engaged with the inner unit, with the inner pressing ring including a plurality of grooves in an outer periphery thereof, with two bolts extending through two of the plurality of grooves of the inner pressing ring and engaged with the two fixing rods, with the inner fixing member abutting a face of the inner pressing ring; and an outer pressing ring threadedly engaged with the outer unit, with the outer pressing ring including a plurality of recesses in a side thereof, with the wire received in one of the plurality of recesses, and with the outer pressing ring abutting the side of outer fixing member.

12. A modularized electric door lock comprising:

an operating device including an inner unit having an inner spindle and an outer unit having an outer spindle, with the operating device configured to be set to a locked state or an unlocked state;

an electric driving device operatively connected to the operating device, with the electric driving device operable to set the operating device to the locked state or the unlocked state;

a latch operatively connected to the inner spindle and the outer spindle of the operating device, with the operating device actuating the latch to move between a latching position and an unlatching position;

an inner operating member coupled to the inner spindle, wherein operation of the inner operating member actuates the inner spindle to move the latch between the latching position and the unlatching position;

an outer operating member coupled to the outer spindle, wherein when the operating device is set to the unlocked state, operation of the outer operating member actuates the outer spindle to move the latch between the latching position and the unlatching position, and wherein when the operating device is set to the locked state, operation of the outer operating member does not actuate the operating device to move the latch from the latching position to the unlatching position;

an inner assembling portion coupled to the inner unit of the operating device;

an inner electric device detachably coupled to the inner assembling portion and detachably and electrically connected to the electric driving device;

an outer assembling portion coupled to the outer unit of the operating device;

an outer electric device detachably and electrically connected to the inner electric device and configured to input unlocking information to the inner electric device, with the outer electric device detachably coupled to the outer assembling portion; and a power supply detachably and electrically connected to the inner electric device, with the operating device further including an outer insertion groove in an outer periphery of the outer unit and an inner insertion groove in the inner unit and in communication with the outer insertion groove, with the inner electric device including a first socket, with the outer electric device including a second socket, with a wire received in the inner insertion groove and the outer insertion groove, with the wire including a first plug detachably and electrically connected to the first socket of the inner electric device and a second plug detachably and electrically connected to the second socket of the outer electric device, with the inner assembling portion including an inner fixing member coupled to the inner unit of the operating device, with the inner fixing member including a coupling hole receiving the inner unit of the operating device, with the coupling hole including a protrusion on an inner periphery thereof, with the protrusion engaged with the inner insertion groove of the inner unit to prevent the inner fixing member from rotating relative to the operating device, with the inner electric device detachably coupled to the inner fixing member, with the outer assembling portion including an outer fixing member coupled to the outer unit of the operating device, with the outer fixing member including an engagement hole receiving the outer unit of the operating device, with the engagement hole including a tooth on an inner periphery thereof, with the outer fixing member further including two fixing rods extending from a side thereof and adapted to couple with a door, with the outer fixing member being not rotatable relative to the door, and with the tooth of the outer fixing member engaged with the outer insertion groove of the outer unit to prevent the outer fixing member from rotating relative to the operating device.

13. The modularized electric door lock as claimed in claim 12, with the inner assembling portion including:

an inner fixing member non-rotatably mounted to the inner unit of the operating device, with the inner electric device detachably coupled to the inner fixing member; and an inner cover including a through-hole and a mounting portion spaced from the through-hole, with the inner operating member extending through the through-hole of the inner cover, with the mounting portion including an engagement side, with the power supply including at least one hook on a side thereof, and with the at least one hook of the power supply detachably coupled to the engagement side of the mounting portion.

14. The modularized electric door lock as claimed in claim 13, with the inner fixing member further including an engaging portion on a side thereof, with the inner electric device further including an engagement portion on a side thereof, with the engagement portion of the inner electric device detachably coupled to the engaging portion of the inner fixing member.

15. The door lock as claimed in claim 12, further comprising:

an inner pressing ring threadedly engaged with the inner unit, with the inner pressing ring including a plurality of grooves in an outer periphery thereof, with two bolts extending through two of the plurality of grooves of the inner pressing ring and engaged with the two fixing rods, with the inner fixing member abutting a face of the inner pressing ring; and an outer pressing ring threadedly engaged with the outer unit, with the outer pressing ring including a plurality of recesses in a side thereof, with the wire received in one of the plurality of recesses, and with the outer pressing ring abutting the side of outer fixing member.

16. The modularized electric door lock as claimed in claim 13, with the inner cover further including a receptacle, with the power supply further including a coupling groove aligned with the receptacle, with the power supply further including a through-hole extending from an outer surface thereof to the coupling groove, with the modularized electric door lock further comprising:

an engagement button slideably mounted in the receptacle, with the engagement button movable along a central axis of the receptacle between a front position partially outside of the receptacle and a rear position retracted into the receptacle, wherein the engagement button in the front position engages with the coupling groove of the power supply to prevent the power supply from disengaging from the inner cover, and wherein the engagement button in the rear position disengages from the coupling groove of the power supply to permit disengagement of the power supply from the inner cover, with the power supply engaged with the inner cover, the power supply is electrically connected to the inner electric device, and with the power supply disengaged from the inner cover, the power supply is not electrically connected to the inner electric device.

17. The modularized electric door lock as claimed in claim 12, with the outer electric device including an input portion, with the input portion being one of a wireless transmitter, a keypad type input device, a touch screen, and a biological feature pickup device, with the outer assembling portion including an outer cover having a first hole and a second hole, with the outer operating member extending through the first hole, with the outer electric device detachably coupled to the outer cover, and with the second hole receiving the input portion of the outer electric device.

18. The modularized electric door lock as claimed in claim 12, with the operating device further including an outer insertion groove in an outer periphery of the outer unit and an inner insertion groove in the inner unit and in communication with the outer insertion groove, with the inner electric device including a first socket, with the outer electric device including a second socket, with a wire received in the inner insertion groove and the outer insertion groove, with the wire including a first plug detachably and electrically connected to the first socket of the inner electric device and a second plug detachably and electrically connected to the second socket of the outer electric device.

* * * * *